US006179660B1

(12) United States Patent
Salaguinto et al.

(10) Patent No.: US 6,179,660 B1
(45) Date of Patent: Jan. 30, 2001

(54) CONNECTOR APPARATUS

(75) Inventors: Joel Victor Damocles Salaguinto; Tomohiko Kimura, both of Shizuoka-ken (JP)

(73) Assignee: Yazaki Corporation, Tokyo (JP)

( * ) Notice: Under 35 U.S.C. 154(b), the term of this patent shall be extended for 0 days.

(21) Appl. No.: 09/268,683

(22) Filed: Mar. 16, 1999

(30) Foreign Application Priority Data

Mar. 17, 1998 (JP) ..... 10-067319

(51) Int. Cl.[7] ..... H01R 13/40
(52) U.S. Cl. ..... 439/595; 439/585
(58) Field of Search ..... 439/595, 610, 439/98, 585, 752, 752.5, 578, 744, 746

(56) References Cited

U.S. PATENT DOCUMENTS 5,102,349 * 4/1992 Kato et al. ..... 439/489
5,437,563 * 8/1995 Kihira et al. ..... 439/607
5,645,450 * 7/1997 Yamada et al. ..... 439/595
5,716,224 * 2/1998 Masuda et al. ..... 439/138

FOREIGN PATENT DOCUMENTS 6-82767 11/1994 (JP) .

* cited by examiner

*Primary Examiner*—Lincoln Donovan
*Assistant Examiner*—Kyung Lee
(74) *Attorney, Agent, or Firm*—Finnegan, Henderson, Farabow, Garrett & Dunner, L.L.P.

(57) ABSTRACT

A connector apparatus includes: a male housing provided with a flexible engagement lance being engaged with the female terminal so as to prevent the female terminal from slipping out; a female housing provided with a flexible engagement lance being engaged with the male terminal so as to prevent the male terminal from slipping out; and a retainer. In the construction, the retainer is engaged in a regular engagement position with a male and a female connectors which are in the fitted state and is inserted into deflection spaces of the flexible engagement lances so as to prevent deflection thereof. When a male or female terminal is inserted into each of the terminal housing chambers incompletely and the male housing is fitted into the hood section halfway, the retainer prevents movement from a temporary engagement position to another regular engagement position.

6 Claims, 15 Drawing Sheets

CONNECTOR APPARATUS

BACKGROUND OF THE INVENTION

1. Field of the Invention

The present invention relates to a connector apparatus, which is composed of male and female connectors which house male and female terminals and are fitted into each other, and a retainer having a function for double-engaging the respective terminals with the respective connectors, a function for detecting incomplete insertion of the terminals into the connectors and a function for detecting the fitted state of the respective connectors.

2. Description of Related Art

A general connector apparatus in related art additionally includes at least spacers for detecting incomplete insertion state of a terminals into connectors and a retainer for detecting the half-fitted state of the connectors. As a result, a number of parts becomes larger, and a number of steps for mounting these parts to a housing is increased. For this reason, the installation is troublesome and the manufacturing and producing cost is increased.

SUMMARY OF THE INVENTION

The present invention has been achieved with such points in mind.

It therefore is an object of the present invention to provide a connector apparatus which is capable of reducing a number of parts, saving the trouble of the installation, and easily detecting incomplete insertion of terminals into connectors and a fitted state of male and female connectors.

To achieve the object, according to a first aspect of the present invention, there is provided a connector apparatus, comprising: a male connector having a male housing provided with a flexible engagement lance in a terminal housing chamber for housing a female terminal, the engagement lance being engaged with the female terminal so as to prevent the female terminal from slipping out; a female connector having a female housing provided with a flexible engagement lance in a terminal housing chamber for housing a male terminal and having a hood section which is provided integrally with the female housing and into which the male housing is inserted and fitted, the engagement lance being engaged with the male terminal so as to prevent the male terminal from slipping out; and a retainer to be mounted to a temporary engagement position of the female connector from a direction intersecting a fitting direction of the male and female connectors, wherein the retainer is engaged in a regular engagement position with the male and female connectors which are in the fitted state and is inserted into deflection spaces of the flexible engagement lances each of the male and female connectors so as to prevent deflection of the flexible engagement lances; and when one of states alternatively arises where at least one of the male and female terminals is inserted into each of the terminal housing chambers incompletely and where the male housing is fitted into the hood section halfway, the retainer prevents movement from the temporary engagement position to the regular engagement position.

In this connector apparatus, in the state that the retainer is mounted to the temporary engagement position of the female connector from the direction intersecting the fitted direction of the male and female connectors, the male and female connectors are fitted into each other, and the retainer is moved from the temporary engagement position to the regular engagement position. In this case, in the case where the terminals are inserted respectively into the connectors completely, when the retainer is inserted into the deflection spaces of the engagement lances, the retainer can move from the temporary engagement position to the regular engagement position. As a result, it can be detected that the terminals are inserted respectively into the connectors completely. Moreover, in the case where the terminals are inserted into the connectors incompletely, the terminals are not regularly engaged with the engagement lances in the terminal housing chambers respectively. For this reason, the retainer cannot be inserted into the deflection spaces of the engagement lances. As a result, since the retainer cannot be moved from the temporary engagement position to the regular engagement position, it can be detected that the terminals are inserted into the connectors incompletely.

Further, in the case where the male connector housing is inserted and fitted into the hood section completely, the retainer can move from the temporary engagement position to the regular engagement position. For this reason, it can be detected that the male housing is fitted into the hood section completely. Moreover, in the case where the male connector housing is fitted into the hood section halfway, the retainer cannot move from the temporary engagement position to the regular engagement position. For this reason, it can be detected that the male housing is fitted into the hood section halfway.

As mentioned above, in the connector apparatus of the present invention, when the one retainer is mounted to the temporary engagement position of the female housing and after the male housing is fitted into the hood section, the retainer is moved to the regular engagement position, incomplete insertion of the terminals into the connectors, and halfway fitted state of the male housing into the hood section can be detected easily. Therefore, a number of parts and a number of the mounting steps can be reduced, and a number of the detecting operations can be also reduced.

As mentioned above, according to the invention of the first aspect, only by mounting the one retainer to the temporary engagement position of the female housing, double engagement of the terminals with the terminal housing chambers, incomplete insertion of the terminals and halfway fitting of the male and female connectors can be detected. For this reason, a number of parts and a number of the mounting steps can be reduced, and thus the producing cost can be reduced.

In addition, only by moving the one retainer from the temporary engagement position to the regular engagement position, double engagement of the terminals, incomplete insertion of the terminals and halfway fitting of the male and female connectors can be detected easily and simply.

According to a second aspect of the present invention as it depends from the first aspect, there is provided a connector apparatus, wherein the retainer comprises: a main body; deflection regulating plate sections provided integrally with the body, the deflection regulating plate sections being inserted into the deflection spaces of the flexible engagement lances each of the male and female connectors, each of the deflection regulating plate sections comes in contact with the each of the flexible engagement lances when at least one of the male and female terminals is inserted into each of the terminal housing chambers incompletely; an engagement arm which is engaged with the temporary engagement position and the regular engagement position of the female housing; a temporary engagement projection for engaged with the engagement arm so as to maintain the retainer in the temporary engagement position; and a regular engagement projection for holding the retainer in the regular engagement position.

In this connector apparatus, in the state that the retainer is mounted to the temporary engagement position of the female housing, the male housing is inserted and fitted into the hood section. Next, the retainer is moved from the temporary engagement position to the regular engagement position. At this time, the terminals are inserted into the terminal housing chambers of the connectors completely so as to be engaged with the engagement lances regularly. Further, when the male housing is fitted into the hood section completely, the retainer moves from the temporary engagement position to the regular engagement position, and the deflection regulating plate sections on the male and female connectors are inserted into the deflection spaces of the engagement lances, and the engagement arm is engaged with the regular engagement position of the female housing.

In this state, the terminals are double engaged with the terminal housing chambers by regulating unexpected deflection of the engagement lances. Then, it is detected that the terminals are inserted into the connectors completely, and it is detected that the male housing is fitted into the hood section completely.

In the case where after the male housing is fitted into the hood section, the retainer cannot be moved from the temporary engagement position to the regular engagement position, the deflection regulating plate sections cannot be inserted into the deflection spaces of the engagement lances. For this reason, it is detected that the terminals are inserted into the connectors incompletely. Further, since the male housing is not inserted into the hood section completely, the engagement arm cannot move from the temporary engagement position to the regular engagement position. For this reason, it is detected that the male housing is fitted into the hood section halfway.

According to the second aspect of the invention, only by moving the retainer from the temporary engagement position to the regular engagement position, the deflection regulating plate sections are inserted into the deflection spaces of the engagement lances. For this reason, double engagement can be executed easily, and at this time, incomplete insertion of the terminals into the terminal housing chambers, and halfway fitting of the male and female connectors can be detected simultaneously.

According to a third aspect of the present invention as it depends from the first or the second aspect, there is provided a connector apparatus, wherein the retainer is provided with a detection arm which is engaged with the temporary engagement projection and regulates the movement of the retainer from the temporary engagement position to the regular engagement position; and the male housing is provided with a release convex section which comes in contact with the detection arm when the male housing is fitted into the hood section completely and releases the engagement of the detection arm with the temporary engagement projection.

When the male housing is inserted and fitted into the hood section completely, the release convex section releases the engagement of the detection arm with the temporary engagement projection, and the retainer can move from the temporary engagement position to the regular engagement position. As a result, it can be detected that the male housing is fitted into the hood section completely. Moreover, in the case where the male housing is fitted into the hood section halfway, the release convex section cannot release the engagement of the detection arm with the temporary engagement projection. For this reason, the detection arm is being engaged with the temporary engagement projection, and the retainer cannot be moved from the temporary engagement position to the regular engagement position. As a result, it is detected that the male housing is fitted into the hood section halfway.

According to the third aspect of the invention, when the male housing is fitted into the hood section completely, the release convex section releases the engagement of the detection arm with the temporary engagement projection, and the retainer can be moved from the temporary engagement position to the regular engagement position. For this reason, halfway fitting of the male and female connectors can be detected easily and simply.

According to a fourth aspect of the present invention as it depends from the one aspect among the first aspect to the third aspect, there is provided a connector apparatus, wherein each of the female housing, the hood section and the male housing is provided with insertion hole which interconnects the male housing with the deflection spaces of the engagement lances when the male housing is fitted into the hood section completely and through which the deflection regulating plate sections of the male and female connectors.

In this connector apparatus, as for the retainer which is mounted to the temporary engagement position of the female housing, the forward ends of the deflection regulating plate sections on the male and female connector sides are inserted into the male housing and the female housing from the insertion holes. In this case, the deflection regulating plate sections are not inserted into the deflection spaces of the engagement lances. When the retainer is moved from the temporary engagement position to the regular engagement position in the state that the terminals are inserted respectively into the connectors completely and the male housing is fitted into the hood section completely, the deflection regulating plate sections on the male and female connector sides are inserted through the insertion holes into the deflection spaces of the engagement lances.

According to the fourth aspect of the invention, the retainer is mounted to the temporary engagement position of the female housing, and the deflection regulating plate sections are inserted through the insertion holes into the female housing and the male housing. For this reason, double engagement of the terminals with the terminal housing chambers can be executed simultaneously, and incomplete insertion into the terminal housing chambers can be also detected, and thus the detecting operation becomes easy.

According to a fifth aspect of the present invention as it depends from the one aspect among the first aspect to the fourth aspect, there is provided a connector apparatus, wherein the engagement arm is composed of an outer arm which is engaged with the temporary engagement projection or the regular engagement projection on an outer peripheral surface of the female housing and an inner arm which is inserted into the female housing; and the detection arm is engaged with the temporary engagement projection or the regular engagement projection on the outer peripheral surface of the female housing.

In this connector apparatus, in the state that the retainer is mounted to the temporary engagement position of the female housing, the outer arm is engaged with the temporary engagement projection, and in the state that the retainer is mounted to the regular engagement position, the outer arm is engaged with the regular engagement projection.

Therefore, the retainer can be held and maintained at each of the temporary engagement position and regular engagement position.

According to a sixth aspect of the present invention as it depends from the one aspect among the first aspect to the fifth aspect, there is provided a connector apparatus, wherein a lock projection is provided to the male housing; and a lock wall, which is engaged with the lock projection when the male housing is fitted into the hood section completely, is provided on an inner wall of the hood section.

In this connector apparatus, when the male housing is fitted into the hood section completely, the lock projection is engaged with the lock wall, and thus the fitting state of the male and female connectors is maintained.

BRIEF DESCRIPTION OF THE ACCOMPANYING DRAWINGS

The above and further objects and novel features of the present invention will more fully appear from the following detailed description when the same is read in conjunction with the accompanying drawings, in which.

Figure 21:
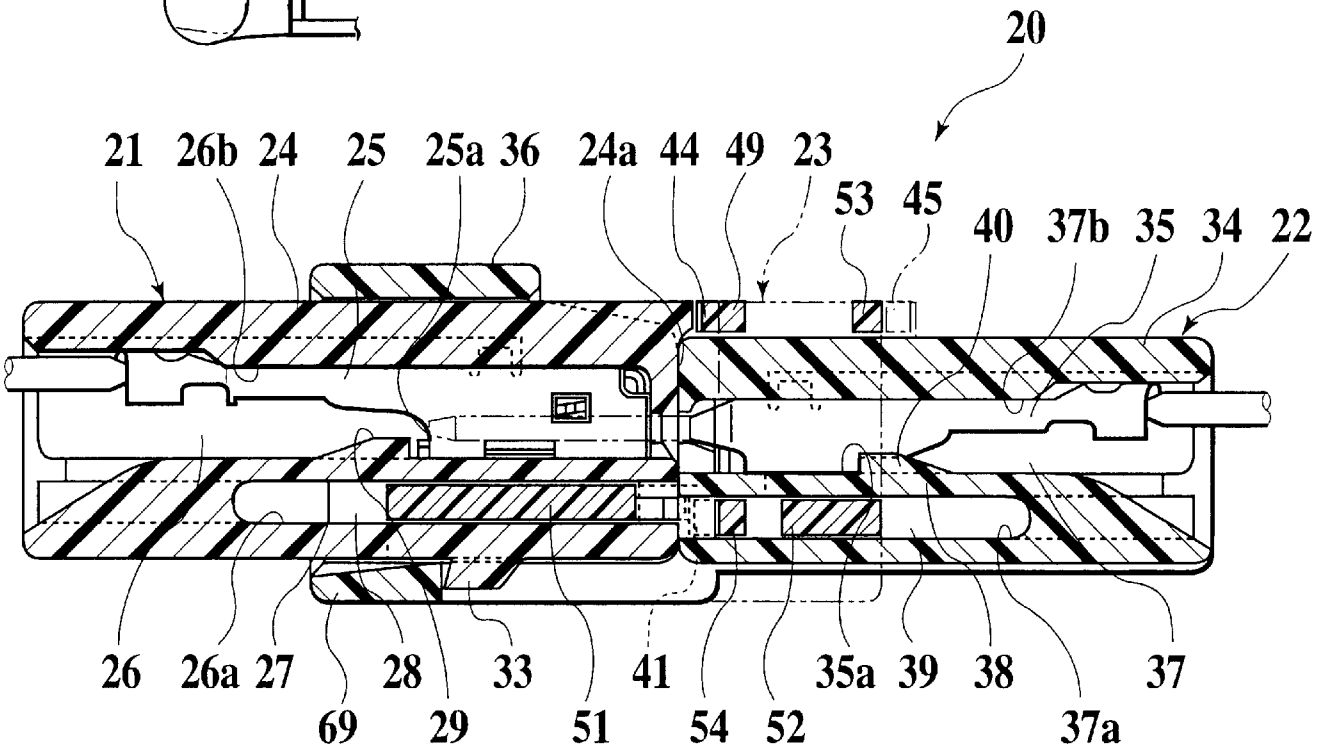
Figure 22:
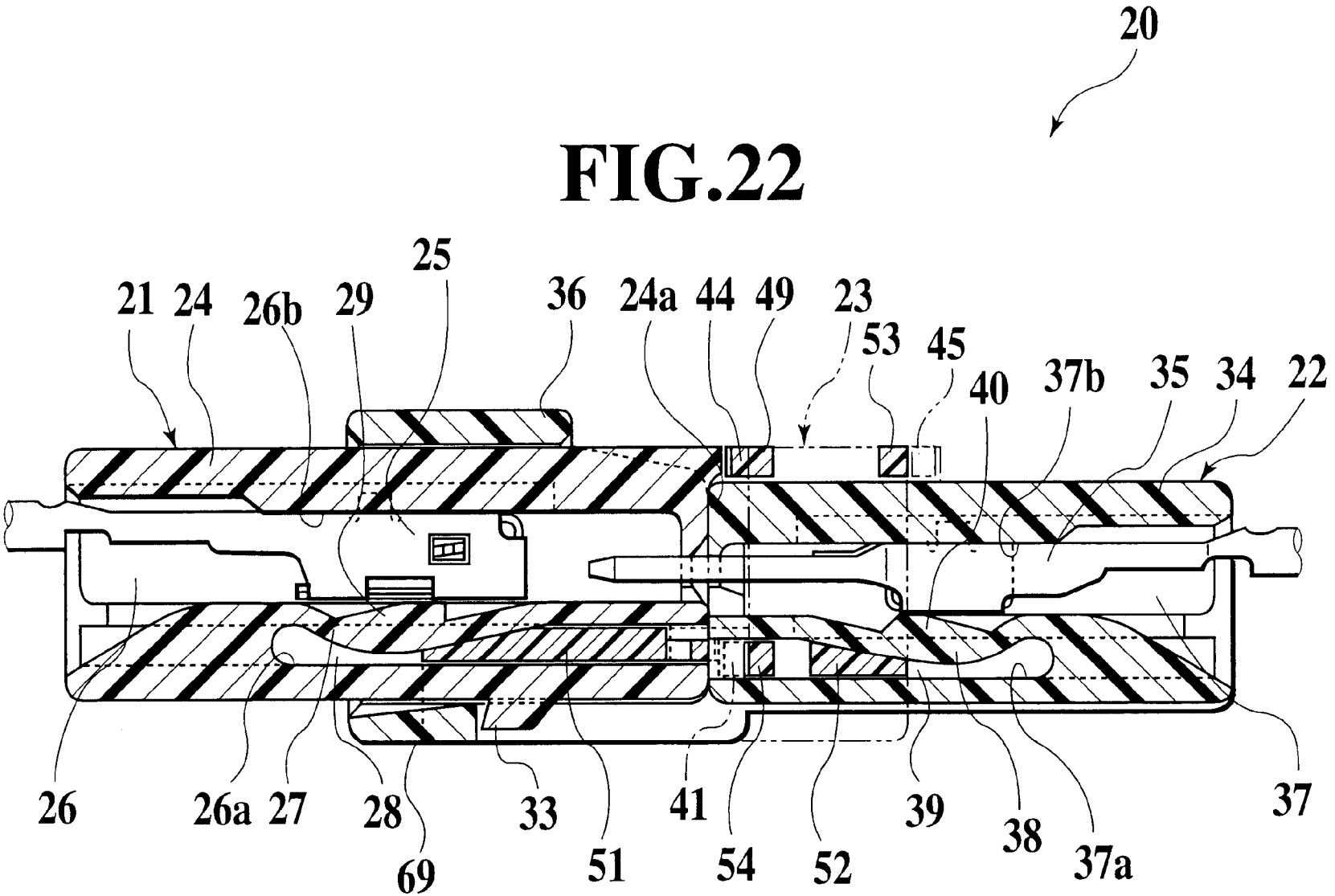

FIG. 21 is a sectional view showing a state that the male and female connectors are fitted into each other completely and the retainer is moved to the regular engagement position; and FIG. 22 is a sectional view showing a state that engagement lances interfere respectively with deflection regulating plate sections when terminals of the male and female connectors are inserted into respective terminal housing chambers incompletely.

DETAILED DESCRIPTION OF THE PREFERRED EMBODIMENTS

There will be detailed below the preferred embodiments of the present invention with reference to the accompanying drawings.

Figure 1:
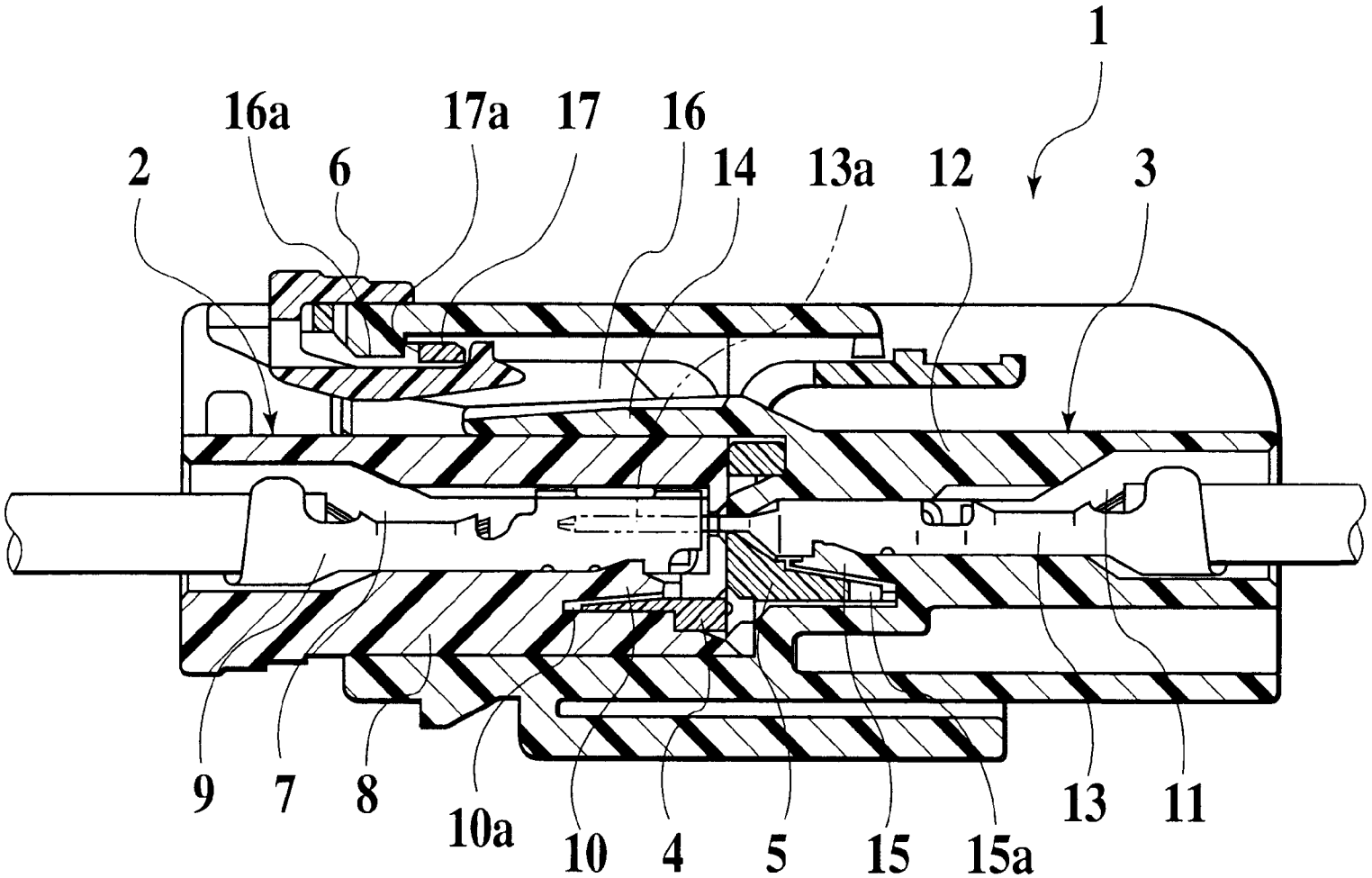
FIG. 1 is a sectional view showing a connector apparatus according to the invention.

FIG. 1 shows a connector apparatus 1 according to the invention where in male and female connectors 2 and 3 which house male and female terminals and are fitted into each other, a function for double-engaging terminals 9 and 13 with the connectors 2 and 3, a function for detecting incomplete insertion of the terminals 9 and 13 into the connectors 2 and 3 and a function for detecting a fitted state of the connectors 2 and 3 are provided.

The connector apparatus 1 is composed of the male connector 2, the female connector 3 into which the male connector 2 is fitted, spacers 4 and 5 for double engagement and for detecting the incomplete insertion of the terminals, and a retainer 6 for detecting the fitting of the male and female connectors.

The male connector 2 is formed by a male housing 8 having a terminal housing chamber 7 therein, and a female terminal 9 housed in the terminal housing chamber 7 of the male housing 8. Moreover, a flexible engagement lance 10 is projected from an inner wall of the terminal housing chamber 7. The engagement lance 10 is engaged with a female terminal 9 housed in the terminal housing chamber 7 so as to prevent the female terminal 9 from slipping out of the terminal housing chamber 7.

In addition, the female connector 3 is formed by a female housing 12 provided with a terminal housing chamber 11 therein, a hood section 14 which is formed integrally with the female housing 12 and into which the male connector 2 is inserted and fitted and from which a contact section 13*a* of a male terminal 13 is projected, and the male terminal 13 housed in the terminal housing chamber 11 of the female housing 12. Moreover, a flexible engagement lance 15 is projected from an inner wall of the terminal housing chamber 11. The engagement lance 15 is engaged with the male terminal 13 housed in the terminal housing chamber 11 so as to prevent the male terminal 13 from slipping out of the terminal housing chamber 11.

In addition, the one spacer 4 is inserted into a deflection space 10*a* of the engagement lance 10 of the male housing 8 so as to regulate unexpected deflection of the engagement lance 10. As a result, the spacer 4 double prevents the female terminal 9 from slipping out of the terminal housing chamber 7.

The other spacer 5 is inserted into a deflection space 15*a* of the engagement lance 15 of the female housing 12 so as to regulate unexpected deflection of the engagement lance 15. As a result, the spacer 5 double prevents the male terminal 13 from slipping out of the terminal housing chamber 11.

Further, the retainer 6 maintains engagement of a lock arm 16 formed integrally with the female housing 12 with a lock frame 17 which is formed integrally with the male housing 8 and forms a lock hole 17*a* where an engagement convex section 16*a* at a forward end of the lock arm 16 is inserted into and engaged with. As a result, the retainer 6 regulates unexpected deflection of the lock arm 16. In the case where the engagement convex section 16*a* of the lock arm 16 cannot be inserted into the lock hole 17*a* completely, namely, in the case of a half-fitted state such that the male housing 8 is not completely fitted into the hood section 14, the retainer 6 cannot be mounted to the female housing 12. As a result, the state that the male housing 8 is fitted into the hood section 14 halfway can be detected.

Further, in the connector apparatus 1, the two spacers 4 and 5 and the one retainer 6 can detect that the terminals 9 and 13 are inserted into the connectors 2 and 3 incompletely, and that the connectors 2 and 3 are fitted into each other halfway. Moreover, the terminals can be double engaged with each other.

However, in the above connector apparatus 1, in addition to the two spacers 4 and 5 for detecting the incomplete insertion of the terminals 9 and 13 into the connectors 2 and 3, the retainer 6 for detecting the half-fitted state of the connectors 2 and 3 is also required. As a result, a number of parts becomes larger, and a number of steps for mounting these parts to the male housing 8 and the female housing 12 is increased. For this reason, the producing cost becomes high.

Nextly, another embodiment of the present invention will be described as an improvement of the connector apparatus hereinbelow, with reference to the other accompanying drawings.

Figure 2:
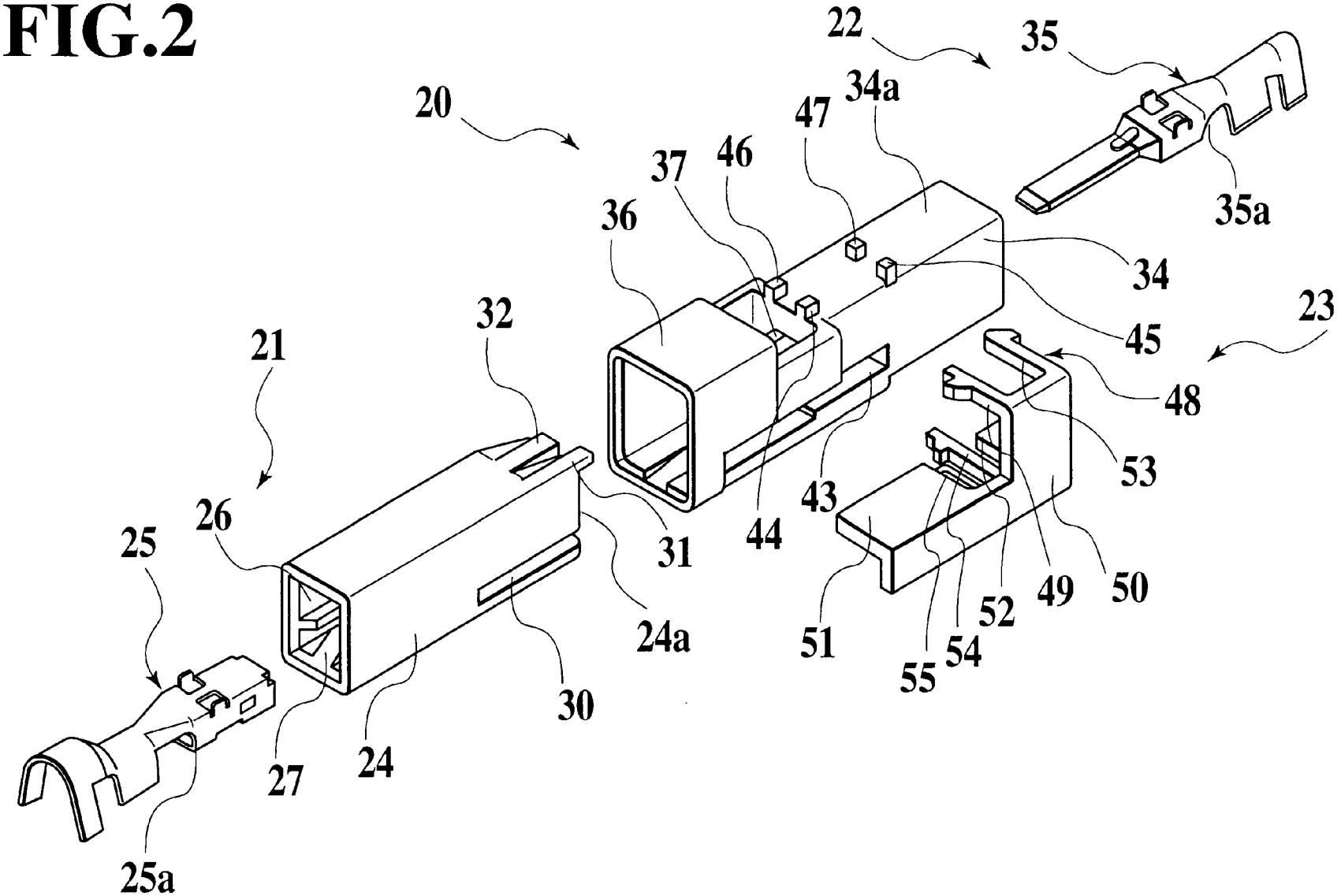
FIG. 2 is an exploded perspective view showing a connector apparatus of the present invention.
Figure 3:
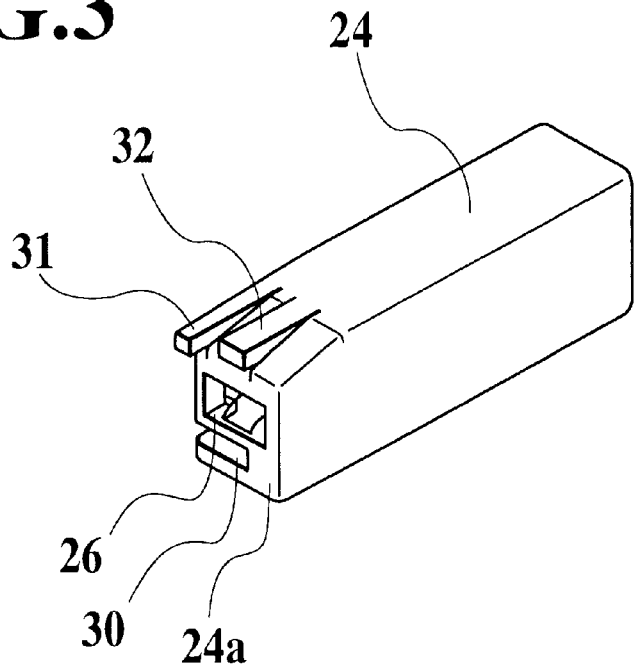
FIG. 3 is a perspective view showing a male housing viewed from a different direction from that in FIG. 2.
Figure 4:
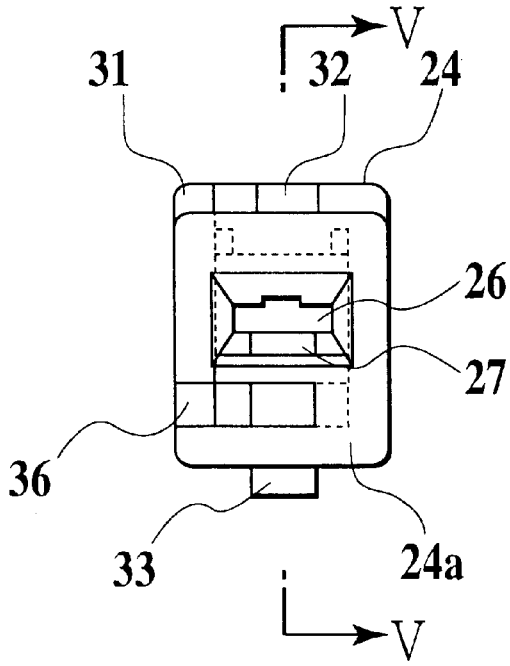
FIG. 4 is a front view showing the male housing viewed from a side of fitting into a female connector.
Figure 5:
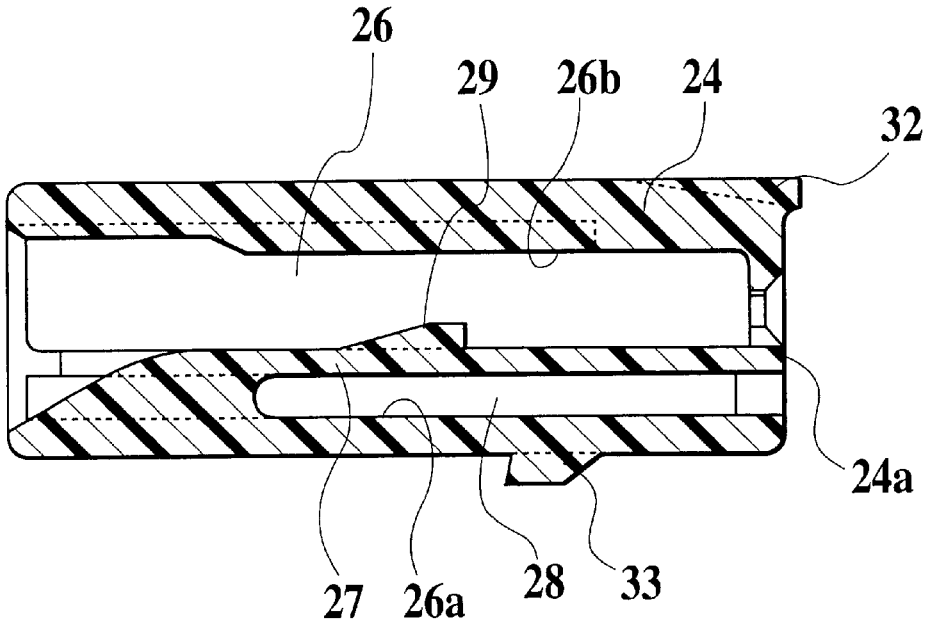
FIG. 5 is a sectional view showing an inside of the male housing taken along line V—V of FIG. 4.
Figure 6:
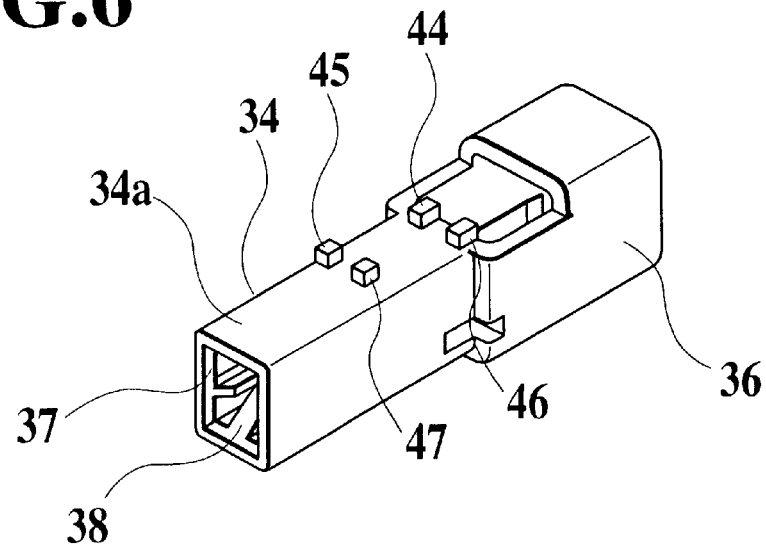
FIG. 6 is a perspective view showing a female housing viewed from a different direction from that in FIG. 2.
Figure 7:
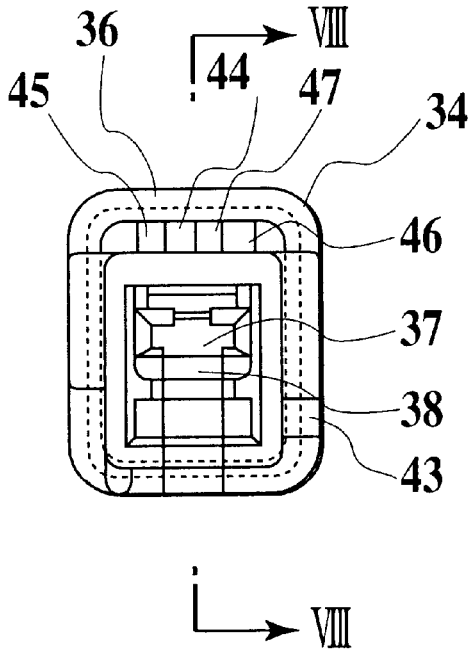
FIG. 7 is a front view showing the female housing viewed from a side of fitting into the male connector.
Figure 8:
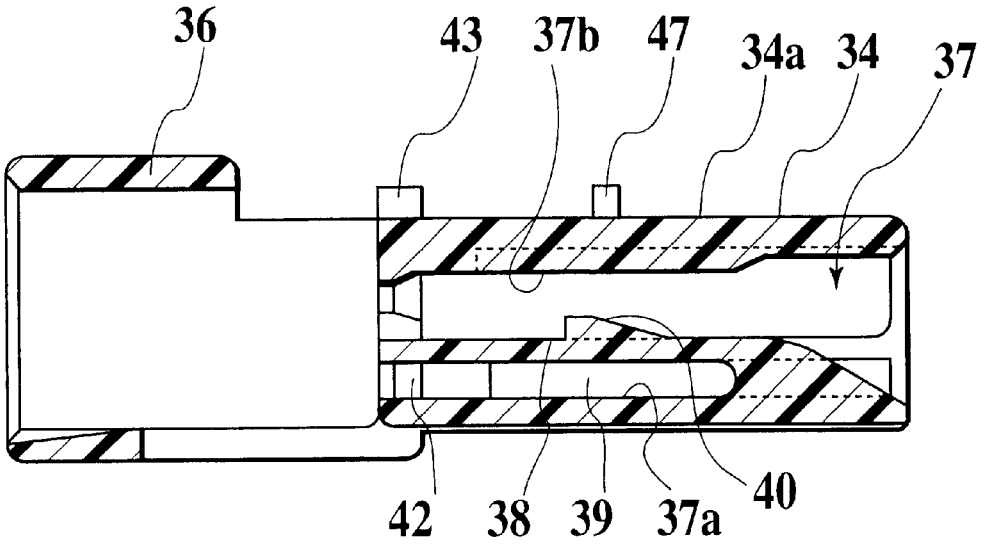
FIG. 8 is a sectional view showing an inside of the female housing taken along line VIII—VIII of FIG. 7.
Figure 9:
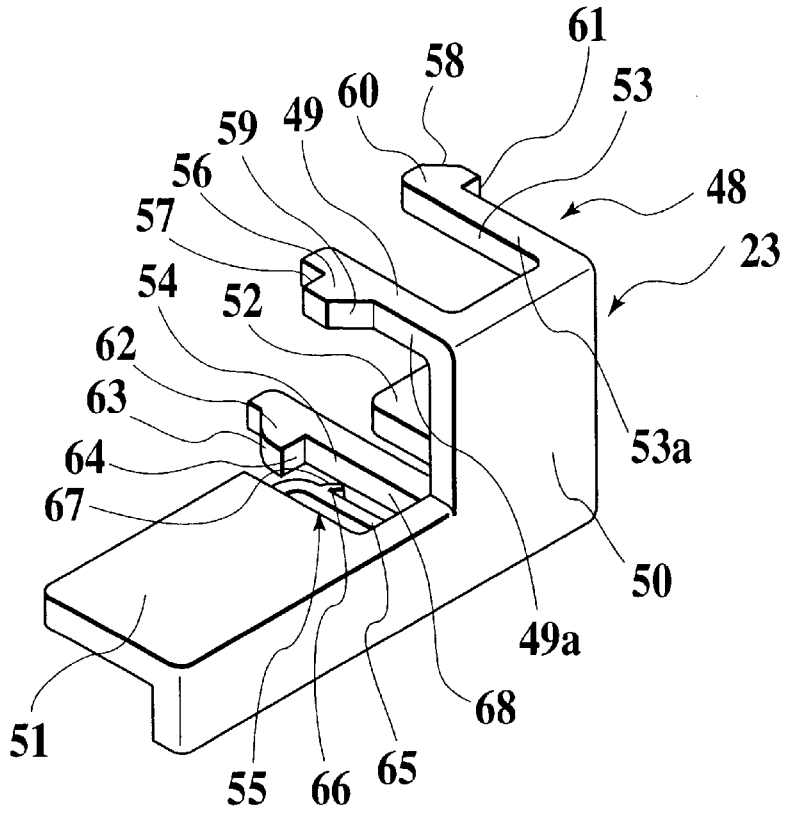
FIG. 9 is a perspective view showing a retainer.
Figure 10:
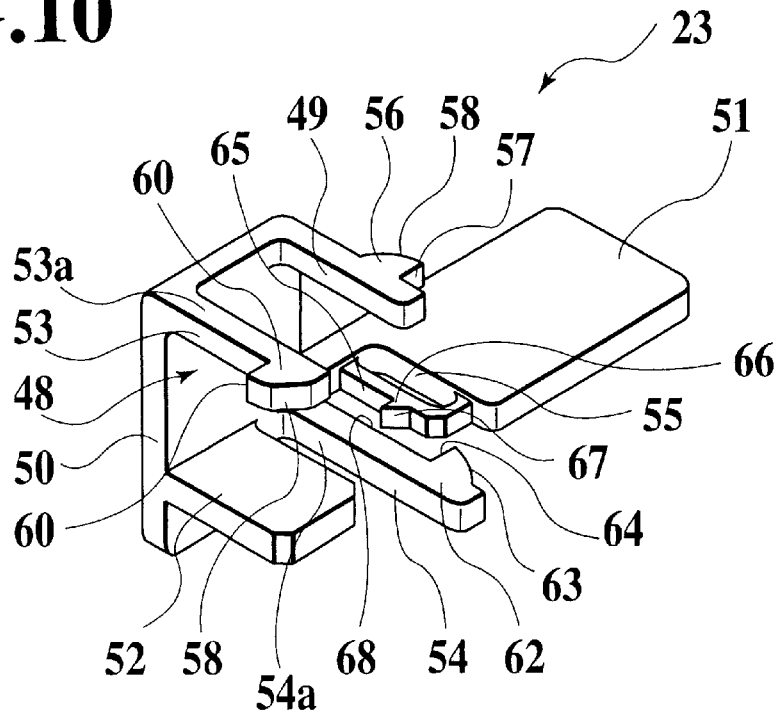
FIG. 10 is a perspective view showing the retainer viewed from a different direction from that in FIG. 9.
Figure 11:
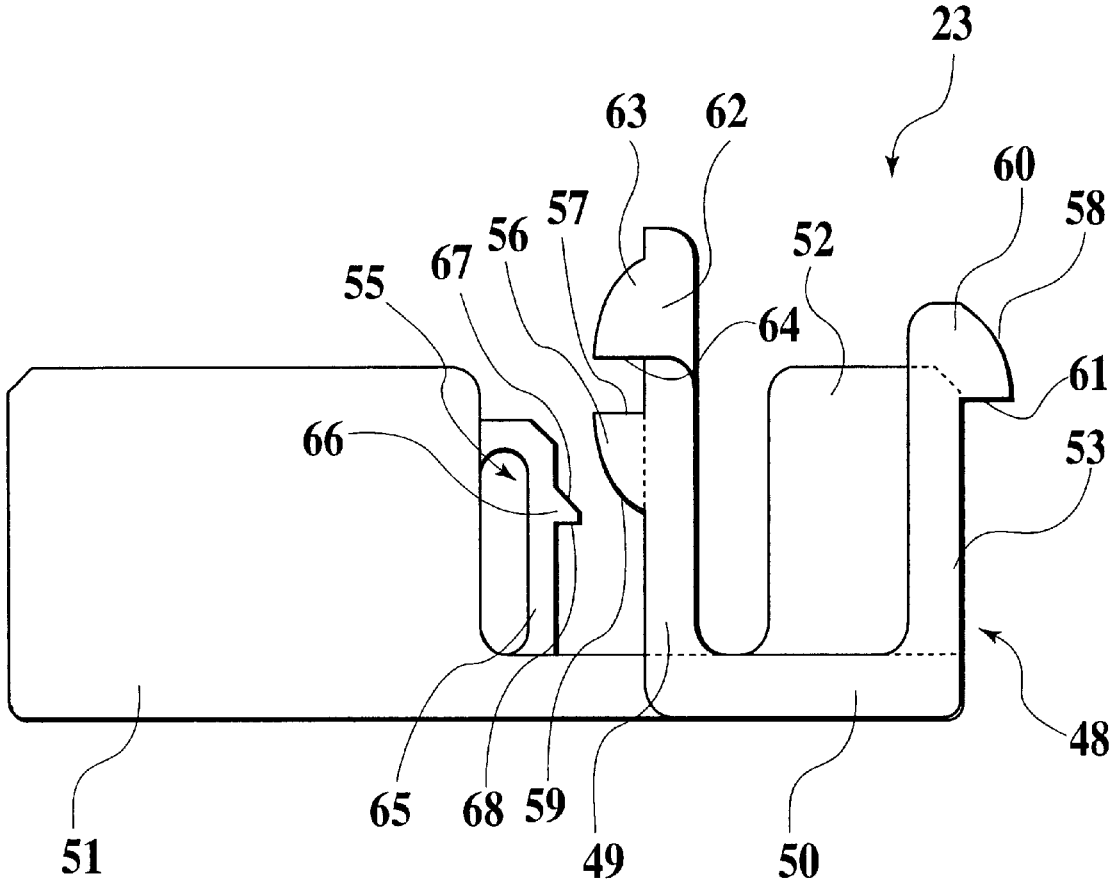
FIG. 11 is a plan view showing the retainer.
Figure 12:
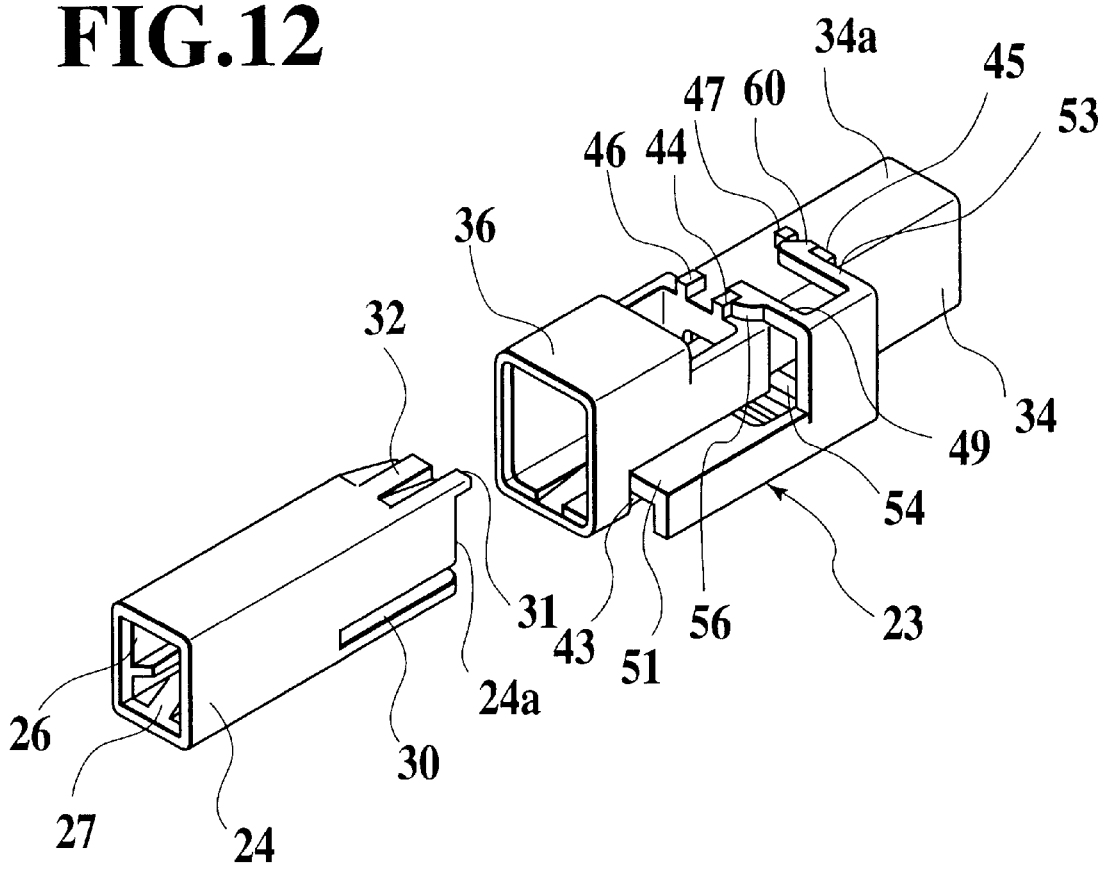
FIG. 12 is a perspective view showing a state before the retainer is mounted to a temporary engagement position of the female housing and the male housing is inserted into a hood section.

FIG. 2 is an exploded perspective view showing a connector apparatus 20 of the present invention, FIGS. 3 through 5 show a male connector 21 of the connector apparatus 20, and FIGS. 6 through 8 show a female connector 22 of the connector apparatus 20. Moreover, FIGS. 9 through 11 show a retainer 23 of the connector apparatus 20.

As shown in FIG. 2, the connector apparatus 20 is composed of the male connector 21, the female connector 22 into which the male connector 21 is inserted and fitted, and the retainer 23 which is mounted to the female connector 22 from a direction intersecting a direction where the male connector 21 is fitted into the female connector 22.

As shown in FIGS. 3 through 5, the male connector 21 is formed by a block-shaped male housing 24 formed integrally by synthetic resin, and a female terminal (see FIG. 2) 25 to be housed in the male housing 24. A terminal housing chamber 26 which is projected in a longitudinal direction is formed in the male housing 24, and it houses the female terminal 25. Moreover, a flexible engagement lance 27 is projected from an inner wall of the terminal housing chamber 26. The engagement lance 27 on a wall section 26*a* side is a deflection space 28 of the engagement lance 27, and an engagement projection 29 is projected towards a wall section 26*b* which is countered to the wall section 26*a*.

In the state that the female terminal 25 is housed in the terminal housing chamber 26, when the engagement projection 29 is engaged with an engagement shoulder 25*a* of the female terminal 25, the female terminal 25 is prevented from slipping out of the terminal housing chamber 26.

In addition, an insertion hole 30 for interconnecting the deflection space 28 of the engagement lance 27 with the outside is provided on an outer periphery of the male housing 24. Moreover, a release convex section 31 having a rectangular section and a guiding convex section 32 are projected from the male housing 24 on a side of a fitting surface 24*a* into the female connector 22 with predetermined separation. Further, a lock projection 33 is projected from the outer periphery of the male housing 24. When the male housing 24 is inserted into the hood section 36 of the female connector 22, the male and female connectors 21 and 22 are fitted into each other.

As shown in FIGS. 6 through 8, the female connector 22 is formed by a block-shaped female housing formed integrally by synthetic resin, a male terminal 35 to be housed in the female housing 34, and a hood section 36 which is formed integrally with the female housing 34 and into which the male housing 24 is inserted. A terminal housing chamber 37 which is pierced in a longitudinal direction is formed in the female housing 34, and it houses the male terminal 35. Moreover, a flexible engagement lance 38 is projected from an inner wall of the terminal housing chamber 37. The engagement lance 38 on a wall section 37*a* side is a deflection space 39 of the engagement lance 38, and an engagement projection 40 is projected towards a wall section 37*b* which is countered to the wall section 37*a*.

In the state that the male terminal 35 is housed in the terminal housing chamber 37, when the engagement projection 40 is engaged with an engagement shoulder 35*a* of the male terminal 35, the male terminal 35 is prevented from slipping out of the terminal housing chamber 37.

Figure 18A:
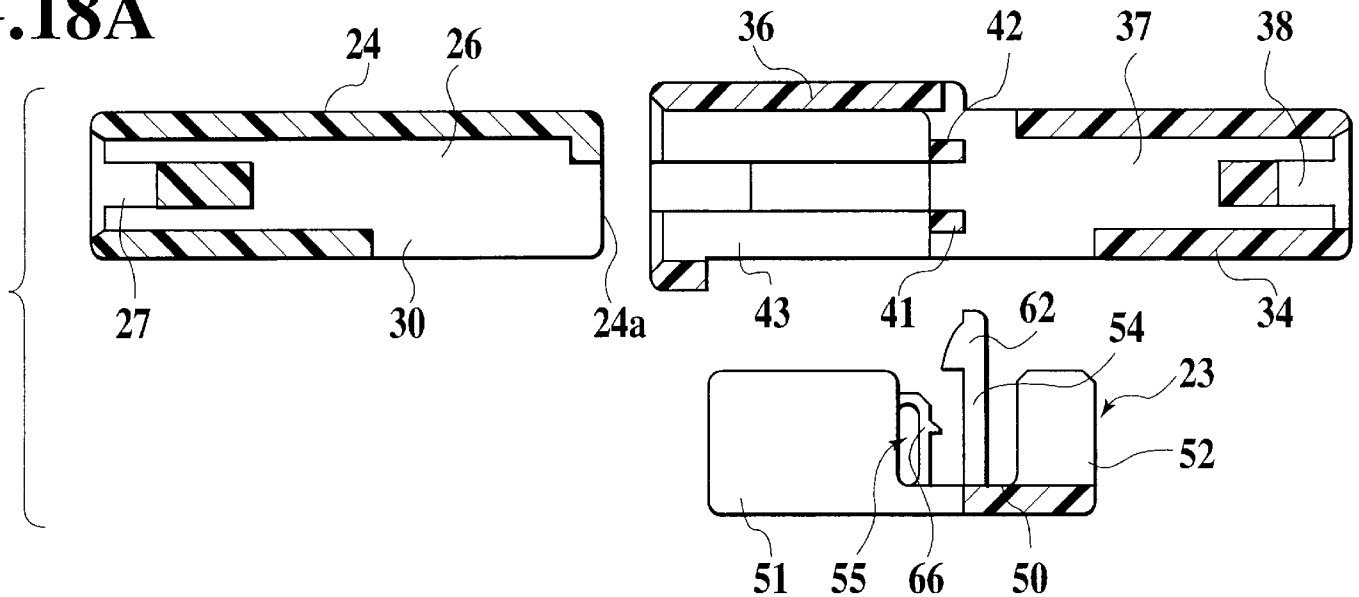
FIG. 18A is a sectional view showing a relationship between the male housing, the female housing and the retainer and showing a state before they are mounted.
Figure 18B:
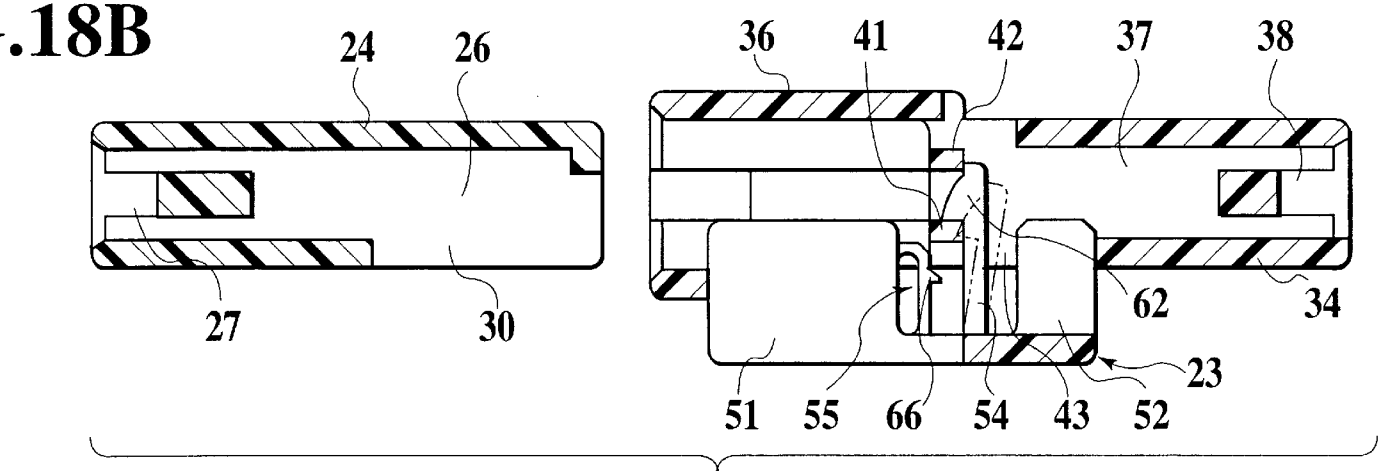
FIG. 18B is a sectional view showing that a state that the retainer is mounted to a temporary engagement position of the female housing.
Figure 19A:
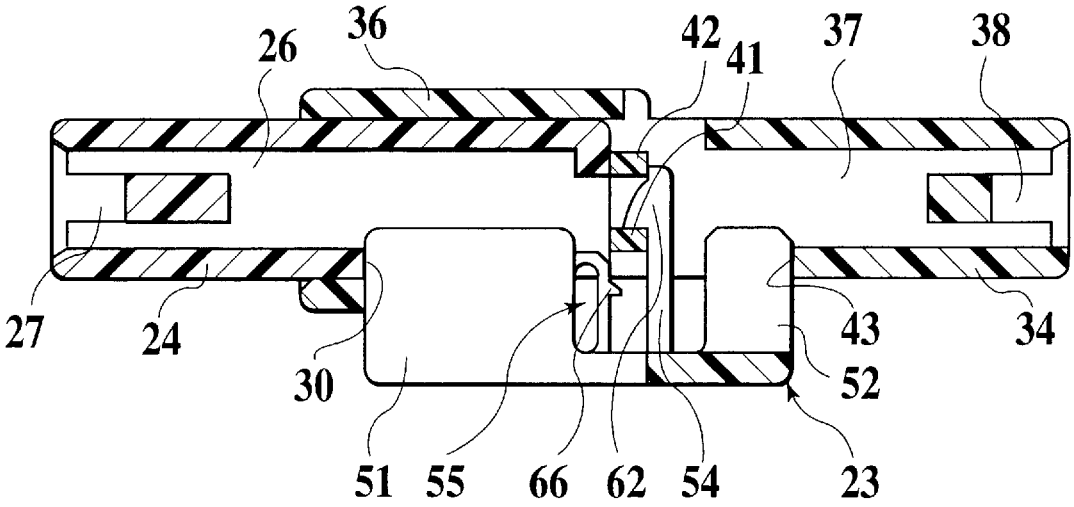
FIG. 19A is a sectional view showing a relationship between the male housing, the female housing and the retainer and showing a state that the male housing is inserted into the hood section completely; FIG.
Figure 19B:
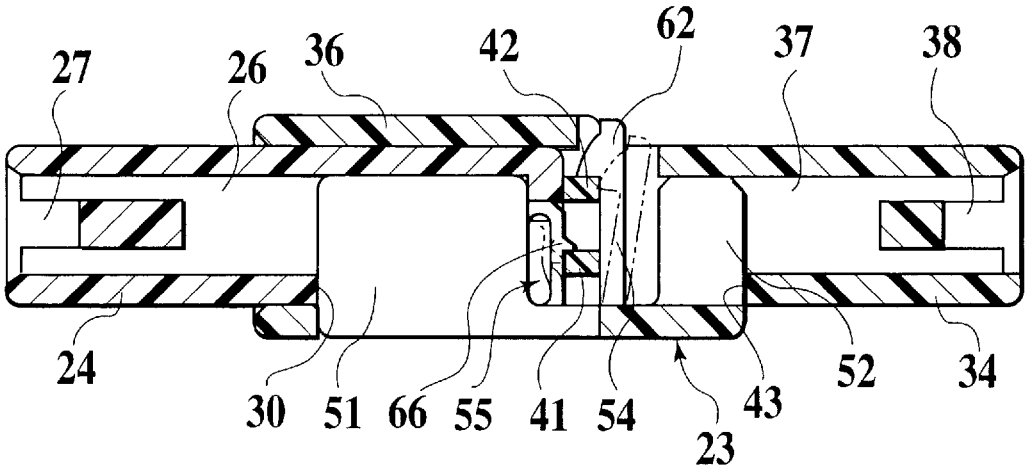
FIG. 19B is a sectional view showing a state that the male housing is inserted into hood section completely and the retainer is moved to the regular engagement position.
Figure 20:
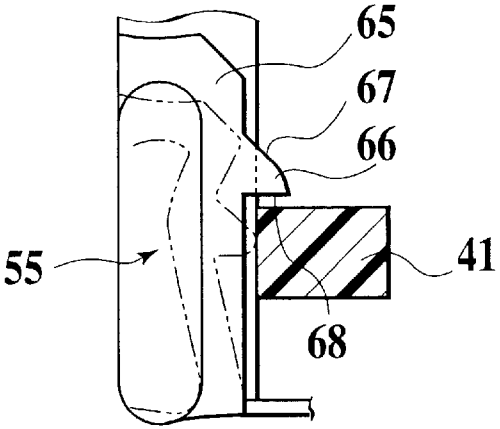
FIG. 20 is an enlarged sectional view showing a constitution and an operation of an engagement convex section.

In addition, as shown in FIGS. 18 and 19, an inner temporary engagement projection 41 and an inner regular engagement projection 42 formed with a predetermined separation from the inner temporary engagement projection 41 are projected from the wall section 37*a* at an end of the terminal housing chamber 37 on the hood section 36 side. Further, an insertion hole (see FIG. 1) 43 for interconnecting the deflection space 39 of the engagement lance 38 with the outside is provided in the female housing 34, and the insertion hole 43 is formed up to the hood section 36. Moreover, a pair of outer temporary engagement projections 44 and 45 are projected from an upper surface 34*a* of the female housing 34 with predetermined separation from each other in a longitudinal direction of the female housing 34 on the hood section 36 side. A pair of outer regular engagement projections 46 and 47 are projected with predetermined separation from each other in a widthwise direction of the temporary engagement projections 44 and 45 and the female housing 34.

The guiding convex section 32 of the male housing 24 which is inserted and fitted into the hood section 36 is inserted between the outer temporary engagement projection 44 and the outer regular engagement projection 46 on the hood section 36 side, and the release convex section 31 of the male housing 24 is inserted in the outside of the outer temporary engagement projection 44. The inner temporary engagement projection 41, the outer temporary engagement projections 44 and 45, the inner regular engagement projection 42 and the outer regular engagement projections 46 and 47 are engaged respectively with an engagement arm 48 and a detection arm 49 of the retainer 23, and the retainer 23 is maintained in a temporary engagement position and a regular engagement position on one side of the female housing 34.

As shown in FIGS. 9 through 11, the retainer 23 is composed of a plate and L shaped main body 50, deflection regulating plate sections 51 and 52 having different sizes which are projected integrally from a lower portion of the main body 50 to a direction intersecting perpendicularly to the main body 50, the detection arm 49 and the engagement arm 48 which are projected from an upper portion of the main body 50 to the same direction as that of the deflection regulating plate sections 51 and 52. Moreover, the engagement arm 48 is composed of an upper engagement arm 53 which is projected from the upper portion of the main body 50 to the same direction as that of the deflection regulating plate sections 51 and 52, a lower engagement arm 54 which is projected from the main body 50 between the deflection regulating plate sections 51 and 52, and an engagement convex section 55 having elasticity.

As shown in FIGS. 12 through 15, the deflection regulating plate sections 51 and 52 are inserted into the female housing 34, the hood section 36 and the male housing 24 from the insertion holes 30 and 43, and are inserted into the deflection spaces 28 and 39 of the engagement lances 27 and 38 respectively. Then, they regulate unexpected deflection of the engagement lances 27 and 38. The detection arm 49 is provided on the main body 50 on the side of the deflection regulating plate section 51, and it is mounted between the outer temporary engagement projections 44 and 45 on the side of the outer temporary engagement projection 44.

A detection projection 56 is projected from the detection arm 49. The detection projection 56 has a plane section 57 whose forward end intersects perpendicularly to a base end section 49*a* of the detection arm 49, and a slanted surface 59 which is slanted from the plane section 57 towards the base end section 49*a*. When the retainer 23 is in the temporary engagement position with respect to the female housing 34, the plane section 57 is projected from the outer temporary engagement projection 44 outward, and thus the retainer 23 is prevented from moving to the regular engagement position.

The upper engagement arm 53 is mounted between the outer temporary engagement projections 44 and 45 on the side of the outer temporary engagement projection 45. An engagement projection 60 is projected from the upper engagement arm 53 outward. The engagement projection 60 has a plane section 61 on the base end section 53*a* side, and a slanted surface 58 which is slanted from its forward end to the plane section 61. When the retainer 23 is in the temporary engagement position with respect to the female housing 34, namely, in the state that the plane section 57 of the detection arm 49 comes in contact with the outside of the outer temporary engagement projection 44, the engagement projection 60 is inserted into and engaged with between the outer temporary engagement projection 45 and the outer regular engagement projection 47.

In addition, the lower engagement arm 54 is provided on the side of the deflection regulating plate section 52, and an engagement projection 62 is projected from its forward end. The engagement projection 62 has a slanted surface 63 which is slanted from its forward end to its base end section, and a plane section 64 which is provided from the slanted surface 63 towards a base end section 54*a*. When the retainer 23 is in the temporary engagement position with respect to the female housing 34, the retainer 23 is inserted into the terminal housing chamber 37 of the female housing 34, and the engagement projection 62 is inserted into and engaged with between the inner temporary engagement projection 41 and the inner regular engagement projection 42.

Further, the engagement convex section 55 is provided on the side of the deflection regulating plate section 51, and it is composed of an elastic frame section 65 which is provided at a side end of the deflection regulating plate section 51, and an engagement projection 66 which is provided in an outer periphery of the elastic frame section 65. The engagement projection 66 has a slanted section 67 and a plane section 68. When the retainer 23 is in the regular engagement position with respect to the female housing 34, the engagement projection 66 is inserted into and engaged with between the inner temporary engagement projection 41 and the inner regular engagement projection 42.

Figure 16A:
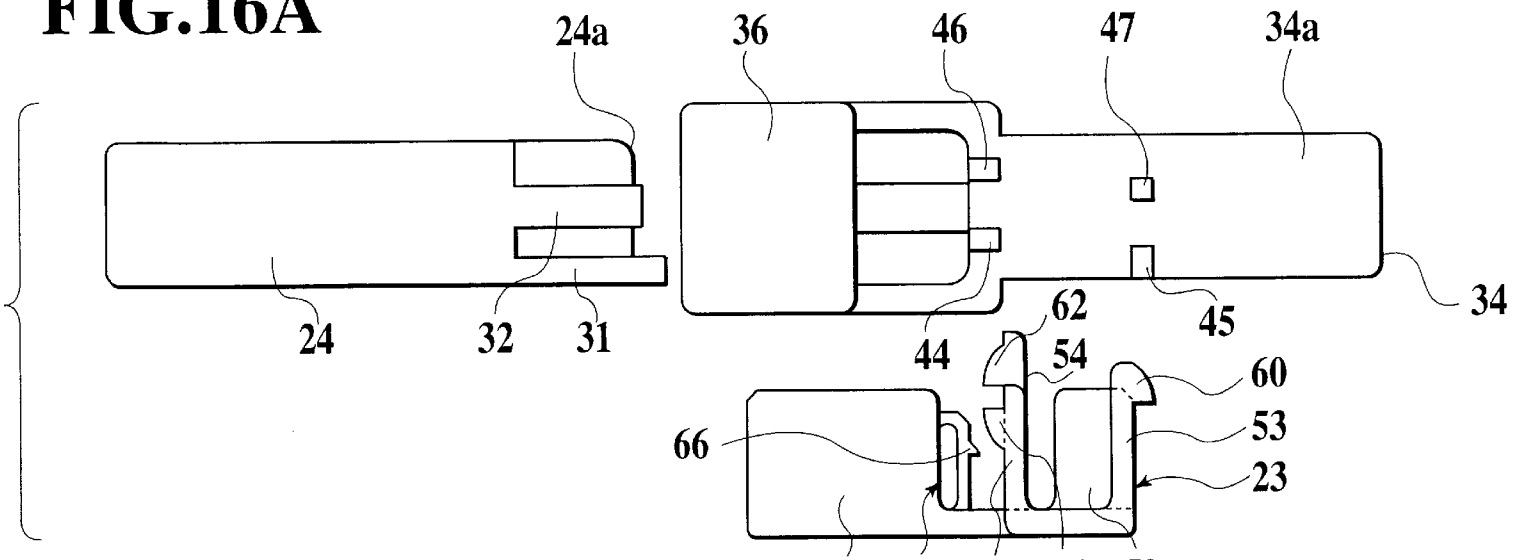
FIG. 16A is a plan view showing a relationship between the male housing, the female housing and the retainer and showing a state before they are mounted.
Figure 16B:
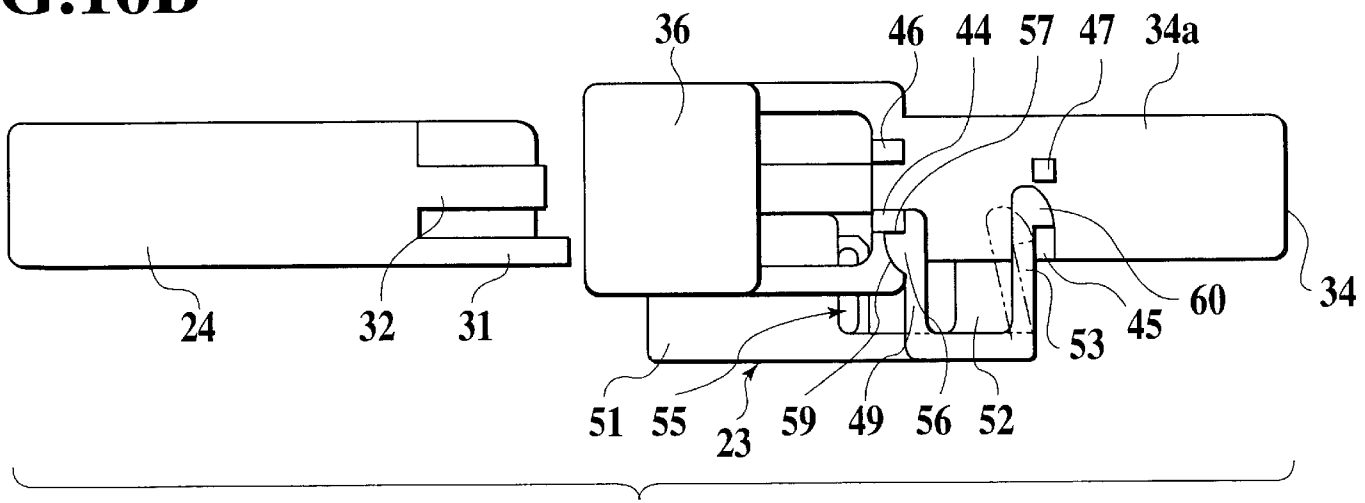
FIG. 16B is a plan view showing a state that the retainer is mounted to the temporary engagement position of the female housing.

In the state that the retainer 23 is mounted to the female housing 34, as shown in FIG. 16B, the detection arm 49 comes in contact with the plane section 57 on the outside of the outer temporary engagement projection 44 in the temporary engagement position, and the upper engagement arm 53 is inserted into and engaged with between the outer temporary engagement projection 45 and the outer regular engagement projection 47. As shown in FIG. 18B, the engagement projection 62 of the lower engagement arm 54 is inserted into and engaged with between the inner temporary engagement projection 41 and the inner regular engagement projection 42. As a result, slipping of the retainer 23 out of the temporary engagement position of the female housing 34 and its movement to the regular engagement position are regulated so that the retainer 23 is maintained in the temporary engagement position. In this state, the deflection regulating plate section 52 is not inserted into the deflection space 39 of the engagement lance 38.

Figure 17A:
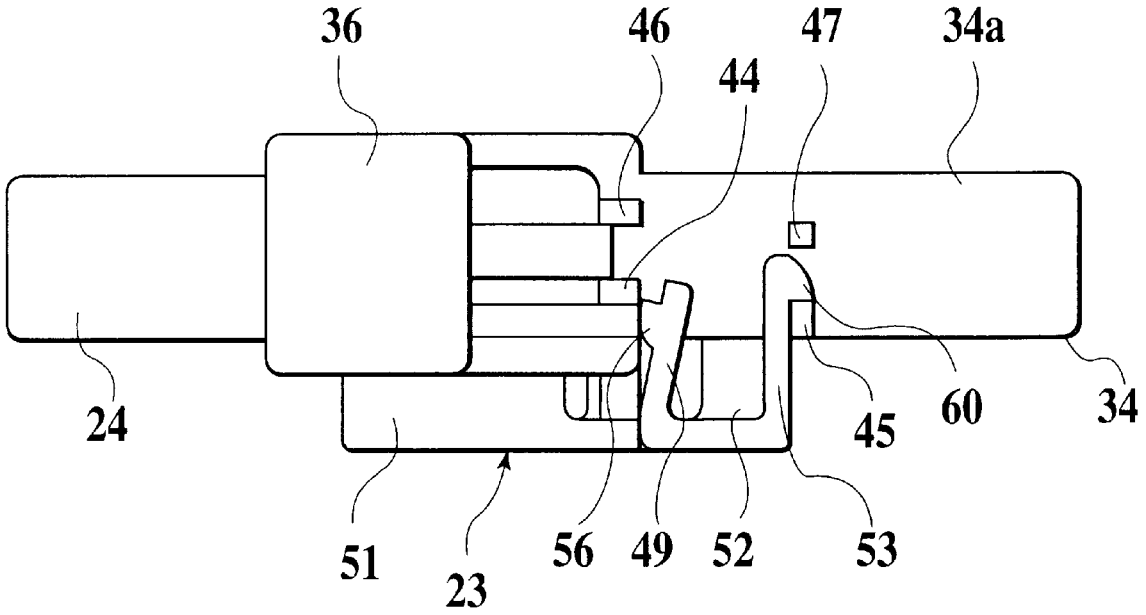
FIG. 17A is a plan view showing a relationship between the male housing, the female housing and the retainer and showing a state that the male housing is inserted into the hood section completely.
Figure 17B:
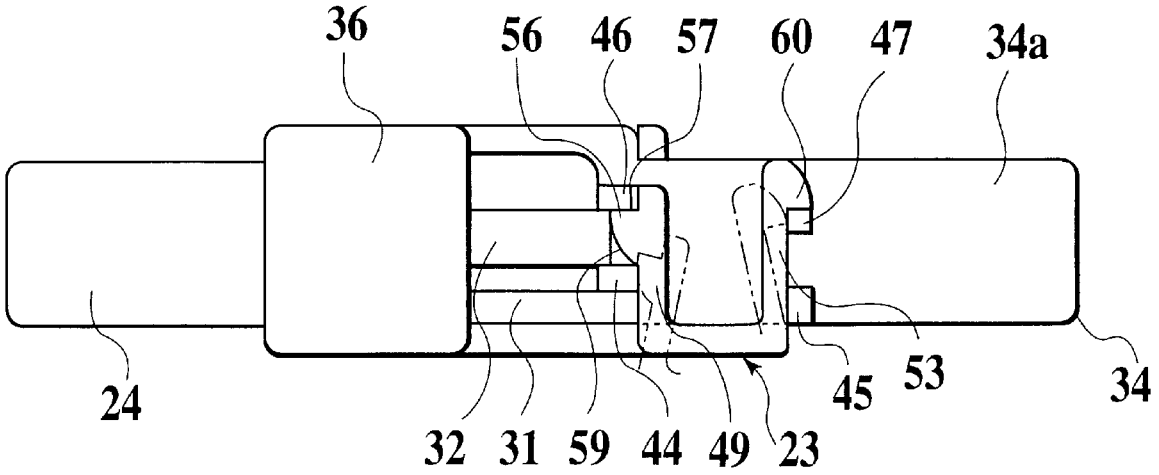
FIG. 17B is a plan view showing a state that the male housing is inserted into the hood section completely and the retainer is moved to the regular engagement position.

In addition, when the retainer 23 is in the regular engagement position, as shown in FIG. 17B, the detection arm 49 is inserted into between the outer temporary engagement projection 44 and the outer regular engagement projection 46, and the plane section 57 comes in contact with the inner side of the outer regular engagement projection 46. Moreover, as for the upper engagement arm 53, the engagement projection 60 is positioned on the outside of the outer regular engagement projection 47, and the plane section 61 comes in contact with the outer surface of the outer regular engagement projection 47. Further, as for the lower engagement arm 54, the engagement projection 62 is positioned on the outside of the inner regular engagement projection 42, and the plane section 64 comes in contact with the outside of the inner regular engagement projection 62, and the engagement convex section 55 is inserted into and engaged with between the inner temporary engagement projection 41 and the inner regular engagement projection 42.

As a result, the retainer 23 is maintained in the regular engagement position of the female housing 34. In this state, the deflection regulating plate section 52 is inserted into the deflection space 39 of the engagement lance 38, and thus unexpected deflection of the engagement lance 38 is regulated.

Here, when the retainer 23 is in the regular engagement position, the male housing 24 is fitted into the hood section 36 completely. As a result, the deflection regulating plate section 51 is inserted into the deflection space 28 of the engagement lance 27 of the male housing 24.

The following will describe a fitting procedure of the male and female connectors 21 and 22, a double engagement function of the terminals 25 and 35 with the connectors 21 and 22 via the retainer 23, a function for detecting incomplete insertion of the terminals 25 and 35 into the connectors 21 an 22 and a fitting detecting function for detecting a fitting state of the connectors 21 and 22 in the connector apparatus 20.

As shown in FIGS. 2, 16A and 18A, the retainer 23 is positioned on one side of the female housing 34, and as shown in FIGS. 16B and 18B, the retainer 23 is mounted to the temporary engagement position of the female housing 34. In this state, the plane section 57 of the detection projection 56 of the detection arm 49 comes in contact with the outside of the outer temporary engagement projection 44, and the engagement projection 60 of the upper engagement arm 53 is inserted into and engaged with between the outer temporary engagement projection 45 and the outer regular engagement projection 47 so that the engagement projection 62 of the lower engagement arm 54 is inserted into and engaged with between the inner temporary engagement projection 41 and the inner regular engagement projection 42.

Figure 13:
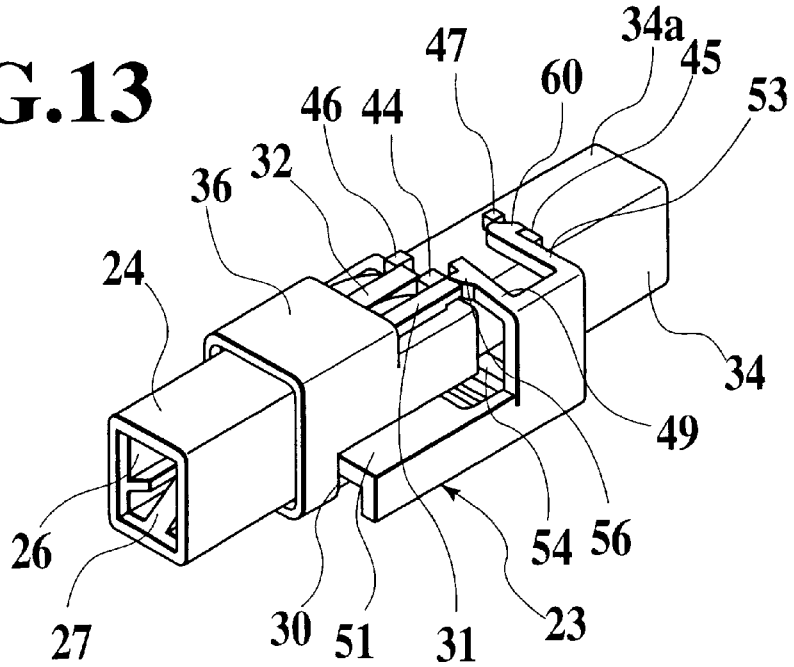
FIG. 13 is a perspective view showing a state that the retainer is mounted to the temporary engagement position of the female housing and the male housing is inserted into the hood section.
Figure 14:
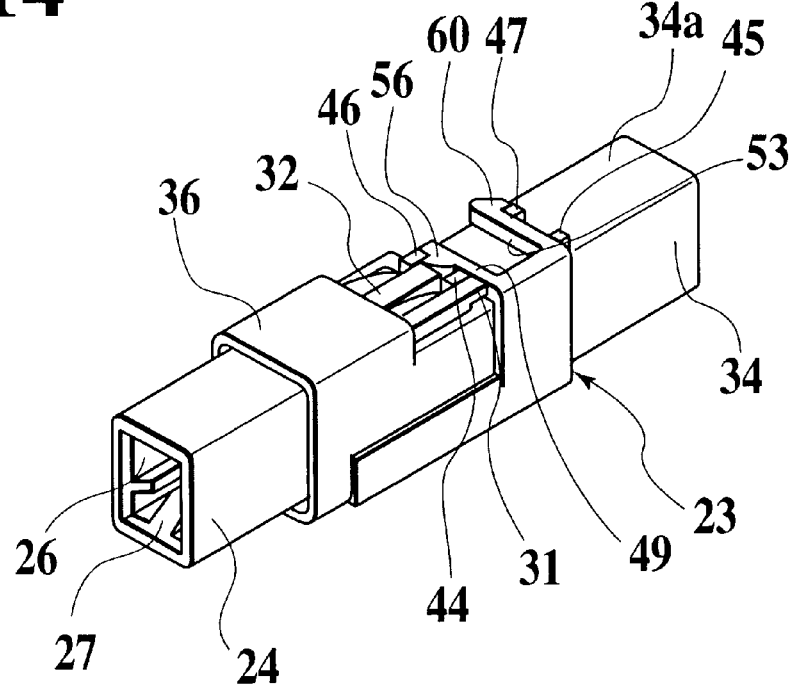
FIG. 14 is a perspective view showing a state that the male housing is fitted into the hood section completely and the retainer is moved to a regular engagement position.
Figure 15:
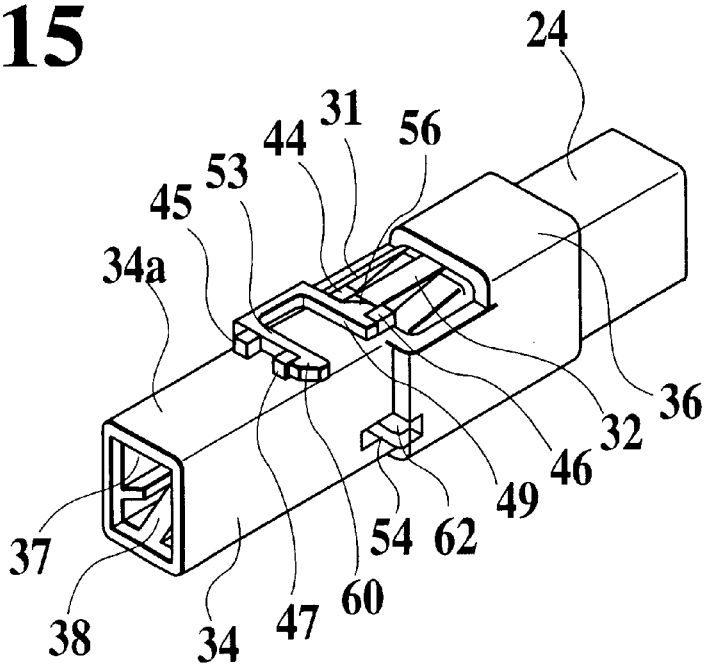
FIG. 15 is a perspective view viewed from a different direction from that in FIG. 14 showing a state that the male housing is fitted into the hood section completely and the retainer is moved to the regular engagement position.

In this state, as shown in FIGS. 13, 17A and 19A, the male housing 24 is inserted into the hood section 36 of the female connector 22 so as to be moved to the inner position of the hood section 36. When the male housing 24 is inserted into the inner position of the hood section 36, the release convex section 31 comes in contact with the detection projection 56 of the detection arm 49. When the male housing 24 is inserted and fitted into the hood section 36 completely, the detection arm 49 is deflected so as to release the engagement of the detection projection 56 with the outer temporary engagement projection 45.

In this state, when the retainer 23 is moved towards the female housing 34 so as to be pressed against the regular engagement position, the detection projection 56 of the detection arm 49 is inserted into and engaged with between the outer temporary engagement projection 44 and the outer regular engagement projection 46. Then, the upper engagement arm 53 is deflected inward, and the engagement projection 60 slips out of between the outer temporary engagement projection 45 and the outer regular engagement projection 47 so that the upper engagement arm 53 is moved to the outside of the outer regular engagement projection 47.

Further, the engagement projection 62 slips out of between the inner temporary engagement projection 41 and the inner regular engagement projection 42, and the lower engagement arm 54 is moved to the outside of the inner regular engagement projection 42. Moreover, the engagement convex section 55 moves to between the inner temporary engagement projection 41 and the inner regular engagement projection 42 so as to be engaged with the inner temporary engagement projection 41. In this case, as shown in FIG. 19, when the elastic frame section 65 is deflected towards the deflection regulating plate section 51, the engagement convex section 55 can move over the inner temporary engagement projection 41. As a result, the retainer 23 is maintained in the regular engagement position.

In this state, as shown in FIG. 21, the deflection regulating plate section 51 is inserted into the deflection space 28 of the engagement lance 27, and the deflection regulating plate section 52 is inserted into the deflection space 39 of the engagement lance 38. Since the deflection regulating plate sections 51 and 52 are inserted respectively into the deflection spaces 28 and 39 of the engagement lances 27 and 38, unexpected deflection of the engagement lances 27 and 38 is regulated, the terminals 25 and 35 can be double engaged with the terminal housing chambers 26 and 37.

In addition, since the retainer 23 can move from the temporary engagement position to the regular engagement position, namely, the engagement of the detection projection 56 of the detection arm 49 with the outer temporary engagement projection 44 is released by the release convex section 31, it is detected that the male housing 24 is fitted into the hood section 36 completely.

Next, in the case where the terminals 25 and 35 are not inserted into respectively into the terminal housing chambers 26 and 37 completely, namely, as shown in FIG. 22, in the case where the engagement lances 27 and 38 are not engaged with the terminals 25 and 35 regularly and are deflected towards the deflection spaces 28 and 39 respectively, even if the male housing 24 is fitted into the hood section 36 completely and the release convex section 31 releases the engagement of the detection arm 49 with the outer temporary engagement projection 44 of the detection projection 56, since the deflection regulating plate sections 51 and 52 interfere with the engagement lances 27 and 38 in the deflection spaces 28 and 39 respectively, the retainer 23 cannot move from the temporary engagement position to the regular engagement position. As a result, it can be detected that the terminals 24 and 35 are not inserted into the terminal housing chambers 26 and 37 completely.

Further, even in the case where the terminals 25 and 35 are inserted into the terminal housing chambers 26 and 37 completely, when the male housing 24 is not fitted into the hood section 36 completely, the release convex section 31 cannot release the engagement of the detection arm 49 with the outer temporary engagement projection 44 of the detection projection 56. For this reason, in this case, the retainer 23 cannot move from the temporary engagement position to the regular engagement position. As a result, it can be detected that the male housing 24 is not fitted into the hood section 36 completely.

According to the connector apparatus 20 of the present embodiment, only by mounting the one retainer 23 to the temporary engagement position of the female housing 34, the double engagement function for the terminals 25 and 35, the function for detecting the incomplete insertion of the terminals 25 and 35 into the connectors 21 and 22, and the fitting detecting function for detecting the fitting state of the connectors 21 and 22 can be obtained. For this reason, a number of parts can be reduced, and a number of the mounting steps can be reduced. Therefore, the producing cost can be reduced.

Further, according to the connector apparatus 20 of the present embodiment, only by moving the retainer 23 from the temporary engagement position to the regular engagement position, incomplete insertion, double engagement and halfway fitting of the terminals 25 and 35 can be detected. As a result, these operations can be performed easily by one operation.

While preferred embodiments of the present invention have been described using specific terms, such description is for illustrative purposes, and it is to be understood that changes and variations may be made without departing from the spirit or scope of the following claims.

What is claimed is:

1. A connector apparatus, comprising:

a male connector having a male housing provided with a flexible engagement lance in a terminal housing chamber for housing a female terminal, the engagement lance of the male connector having a deflection space and being engaged with the female terminal so as to prevent the female terminal from slipping out;

a female connector having a female housing provided with a flexible engagement lance in a terminal housing chamber for housing a male terminal and having a hood section provided integrally with the female housing and into which the male housing is inserted and fitted, the engagement lance of the female connector having a deflection space and being engaged with the male terminal so as to prevent the male terminal from slipping out; and a retainer configured to be mounted in a temporary engagement position with the female connector from a direction intersecting a fitting direction of the male and female connectors and configured to engage in a regular engagement position with the male and female connectors in a fitted state upon insertion of the retainer into the deflection spaces of the flexible engagement lances of each of the male and female connectors to prevent deflection of the flexible engagement lances, wherein the retainer is configured to prevent movement from the temporary engagement position to the regular engagement position upon incomplete insertion of one of the male and female terminals into one of the male and female terminal housing chambers, and the retainer is configured to prevent movement from the temporary engagement position to the regular engagement position upon incomplete insertion of the male housing into the hood section.

2. A connector apparatus according to claim 1, wherein the retainer comprises:

a main body;

a plurality of deflection regulating plate sections provided integrally with the body and configured to insert into the deflection spaces of the flexible engagement lances of the male and female connectors, wherein each of the plurality of deflection regulating plate sections comes in contact with one of the flexible engagement lances of the male and female connectors upon incomplete insertion of at least one of the male and female terminals into at least one of the male and female terminal housing chambers;

an engagement arm configured to engage in the temporary engagement position and the regular engagement position; and a temporary engagement projection configured to engage the engagement arm so as to hold the retainer in the temporary engagement position; and a regular engagement projection configured to hold the retainer in the regular engagement position.

3. A connector apparatus according to claim 2, wherein the retainer is provided with a detection arm configured to engage the temporary engagement projection and regulate the movement of the retainer from the temporary engagement position to the regular engagement position; and the male housing is provided with a release convex section configured to come in contact with the detection arm and release the engagement of the detection arm with the temporary engagement projection upon complete insertion of the male housing into the hood section.

4. A connector apparatus according to claim 2, wherein each of the female housing, the hood section and the male housing is provide with a plurality of insertion holes configured to receive the plurality of deflection regulating plate sections into the deflection space of the engagement lances and configured to interconnect the male housing with the engagement lances upon complete insertion of the male housing into the hood section.

5. A connector apparatus according to claim 2, wherein the engagement arm is composed of an outer arm configured to engage the temporary engagement projection or the regular engagement projection on an outer peripheral surface of the female housing and an inner arm configured to insert into the female housing; and the detection arm is engaged with the temporary engagement projection or the regular engagement projection on an outer peripheral surface of the female housing.

6. A connector apparatus according to claim 1, wherein a lock projection is provided to the male housing; and a lock wall is provided on an inner wall of the hood section and is configured to engage the lock projection upon incomplete insertion of the male housing into the hood section.

* * * * *

UNITED STATES PATENT AND TRADEMARK OFFICE

CERTIFICATE OF CORRECTION

PATENT NO. : 6,179,660 B1
DATED : January 30, 2001
INVENTOR(S) : Joel Victor Damocles Salaguinto et al.

It is certified that error appears in the above-identified patent and that said Letters Patent is hereby corrected as shown below:

Column 14, claim 4,
Line 23, "is provide" should read -- is provided --.

Signed and Sealed this

Second Day of April, 2002

*Attest:*

*Attesting Officer*

JAMES E. ROGAN
*Director of the United States Patent and Trademark Office*